United States Patent [19]

Kawauchi et al.

[11] 4,025,003

[45] May 24, 1977

[54] DEVICE FOR SIMULTANEOUSLY TRAVERSING THREAD GUIDES OF A WINDING APPARATUS FOR TAKING UP A PLURALITY OF THREADS

[75] Inventors: Yoshikazu Kawauchi; Hiroshi Honda, both of Takahama, Japan

[73] Assignee: Kabushiki Kaisha Toyoda Jidoshokki Seisakusho, Kariya, Japan

[22] Filed: Dec. 22, 1975

[21] Appl. No.: 643,279

Related U.S. Application Data

[63] Continuation of Ser. No. 552,299, Feb. 24, 1975, abandoned.

[52] U.S. Cl. ..... 242/43 R; 242/158.3; 242/158.5

[51] Int. Cl.[2] ..... B65H 54/28

[58] Field of Search ..... 242/43 R, 158.3, 158.5; 74/57

[56] References Cited

UNITED STATES PATENTS

| | | | |
|---|---|---|---|
| 3,074,286 | 1/1963 | Altice et al. | 242/43 R UX |
| 3,248,064 | 4/1966 | Rollings | 242/43 R |
| 3,353,761 | 11/1967 | Graf | 242/43 R |
| 3,527,422 | 9/1970 | Conrad | 242/43 R |
| 3,527,423 | 9/1970 | Burow | 242/43 R |
| 3,792,819 | 2/1974 | Schippers | 242/43 R |

FOREIGN PATENTS OR APPLICATIONS

| | | | |
|---|---|---|---|
| 2,005,621 | 8/1971 | Germany | 242/43 R |

*Primary Examiner*—Stanley N. Gilreath
*Attorney, Agent, or Firm*—Paul & Paul

[57] ABSTRACT

In a winding apparatus for simultaneously taking up a plurality of threads, comprising a common friction roller, a traverse device provided with a common cylindrical traverse cam rotatably disposed at a position adjacent to said friction roller, a cam box holding the traverse cam therein and a pair of guide rails secured to said cam box for guiding a plurality of thread guides therealong, the cam box is supported in a condition such that it is capable of turning about the longitudinal axis of the traverse cam from a normal working position where the guide rails are positioned at a side of the friction roller to a predetermined position opposite the friction roller with respect to the longitudinal axis of the traverse cam. The cam box is stably held at the normal working position or at the above-mentioned predetermined position alternatively.

6 Claims, 5 Drawing Figures

DEVICE FOR SIMULTANEOUSLY TRAVERSING THREAD GUIDES OF A WINDING APPARATUS FOR TAKING UP A PLURALITY OF THREADS

This is a continuation of application Ser. No. 552,299, filed Feb. 24, 1975, now abandoned.

SUMMARY OF THE INVENTION

The present invention relates to an improved device for simultaneously traversing thread guides of a winding apparatus for taking-up a plurality of threads on corresponding independent bobbins, more particularly, relates to an improved device for simultaneously traversing threads guides of a winding apparatus comprising at least one take-up unit provided with a common cylindrical traverse cam wherein at least a pair of endless traverse cam grooves are helically formed on the cylindrical surface thereof so that each thread guide is capable of sliding along the corresponding cam grooves while traversing along the axial direction of the common cylindrical traverse cam.

It is well known that, in the conventional traverse winder, a pair of horizontal traverse guide rails are mounted on a traverse cam box which covers a cylindrical traverse cam provided with an endless traverse cam groove helically formed on the cylindrical surface thereof, and the traverse motion of a thread guide is guided by the above-mentioned horizontal thread guide rails in such a condition that the thread guide is displaced along a horizontal guide groove formed between the above-mentioned rails, while the thread guide slides along the traverse cam groove. Therefore, very strong shock is repeatedly imparted to the thread guide at both terminals of the traverse motion. Accordingly, it is necessary to change the thread guide frequently, because of serious wear. In the above-mentioned conventional traverse winder, when it is required to change the thread guide, it is inevitable to separate the traverse guide rails from the traverse cam box. Further, since a friction roller for driving a yarn package formed on a bobbin is disposed at a position adjacently facing the traverse guide rails, the above-mentioned exchanging of a used thread guide for a fresh thread guide requires a very complex and skilled manual operation.

The principal object of the present invention is to provide an improved device for simultaneously traversing thread guides of a winding apparatus for taking-up a plurality of threads on the corresponding bobbins, whereby the above-mentioned drawback of the conventional traverse winder can be eliminated.

To attain this purpose, in the winding unit according to the present invention, the cam box is mounted on the winding unit in such a condition that the traverse rails secured to the cam box are capable of turning about the axis of the traverse cam from a normal working position to a predetermined position when it is required to change the used thread guide for a fresh thread guide, so that the changing operation of said thread guides can be carried out easily at the above-mentioned predetermined position, free from the friction roller.

DETAILED EXPLANATION OF THE INVENTION

Figure 1:
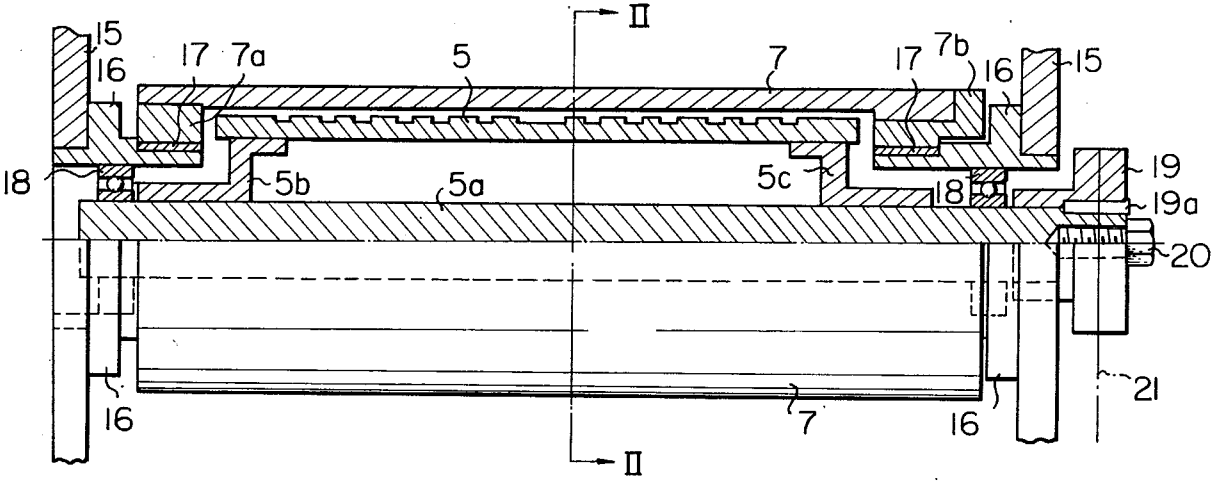
FIG. 1 is a schematic front view of a traverse device, partly in section taken along a longitudinal axis thereof, according to the present invention.
Figure 2:
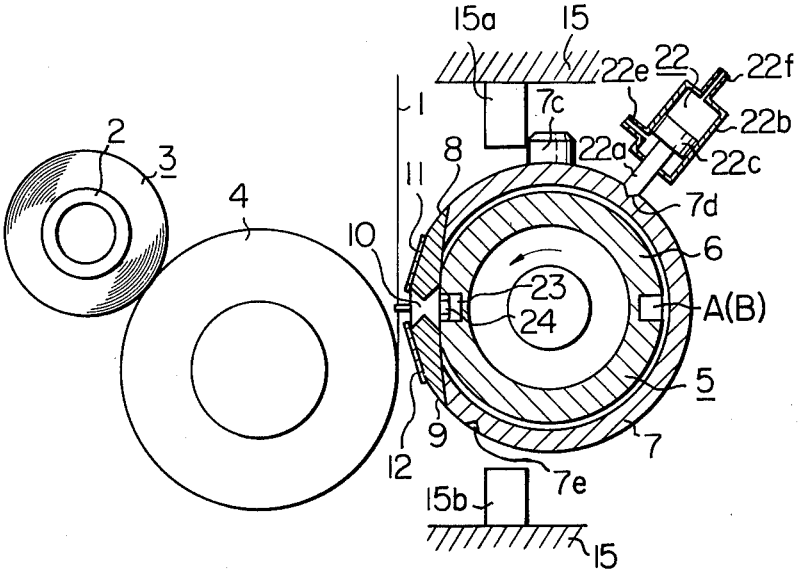
FIG. 2 is a schematic side view of the traverse device, partly in section along a line II—II in FIG. 1, together with related elements of a winding unit, according to the present invention.

The detailed construction of the improved device for simultaneously traversing thread guides of a winding unit according to the present invention (hereinafter referred to as an improved traverse device) is shown in FIGS. 1 and 2. In the winding unit shown in FIG. 1, a thread 1 introduced into the winding unit is wound onto a bobbin 2 so as to form a thread package 3 which rotates by frictional contact with a friction roller 4. During the above-mentioned winding operation, the thread 1 is traversed along the axial direction of the friction roller 4 by means of a traverse device 5.

Said traverse device 5 comprises a cylindrical traverse cam 6 rotatably mounted on the frame of the winding unit in parallel condition to the friction roller 4 and a cylindrical cam box 7 provided with a horizontal aperture at a position facing the friction roller 4 wherein the traverse cam 6 is rotatably disposed, and a pair of horizontal traverse guide rails 8 and 9 secured to the cylindrical cam box 7 at horizontal edge portions of the above-mentioned aperture so that a horizontal guide groove is formed between the traverse guide rails 8 and 9, and a thread guide 10 is slidably engaged in the above-mentioned horizontal guide groove. A pair of cover plates 11 and 12 are secured to the traverse guide rails 8 and 9 respectively, so that the above-mentioned horizontal guide groove is protected from dust.

The cam box 7 is turnably mounted on a cylindrical bracket 16, which is rigidly held by a frame 15 of a winding unit, by way of a cylindrical collar 17 at both ends thereof, in such a way that a pair of cylindrical elements 7*a* and 7*b* rigidly closing both ends of the cam box 7 are capable of turning about the corresponding collar 17. The cylindrical traverse cam 6 is rigidly mounted on a cam shaft 5a by way of a pair of cylindrical brackets 5*b* and 5*c* and both end portions of the cam shaft 5*a* are turnably supported by the cylindrical brackets 15 and 16 by way of the bearings 18. Said cam shaft 5a is provided with a pulley 19 which is secured by a fastening bolt 20. To prevent the pulley 19 from slidably turning about the cam shaft 5*a*, a key 19*a* is inserted therebetween as shown in FIG. 1. The pulley 19 is driven by a driving motor (not shown) by way of a pulley (not shown), secured to a shaft of the above-mentioned motor, and an endless belt 21. To fix the relative angular position of the cam box 7 to the cylindrical traverse cam 6, a pin 7*c* is projected from an outer cylindrical surface of the cam box 7 at an axial end portion thereof and a pair of stoppers 15*a* and 15*b* are secured to the frame 15 in a position capable of engaging the pin 7*c* with the stopper 15*a* during the normal taking up operation and engaging the pin 7*c* with the stopper 15*b* during the changing operation of the thread guides 10. To maintain the above-mentioned two engaging positions of the pin 7*c* with the stoppers 15*a* or 15*b*, a pair of recesses 7*d* and 7*e* are formed in the outer cylindrical surface of the cam box 7 at the axial end portion hereof, and an auxiliary stopper 22 is secured to the machine frame 15 at a position where a movable pin 22*a* is capable of engaging with either one of the recesses 7*d* and 7*e*. The auxiliary stopper 22 comprises a pneumatic cylinder 22*b* and a piston 22*c* which is connected to the movable pin 22*a*, and a pair of conduits 22*e* and 22*f*. These conduits 22*e* and 22*f* are connected to a supply source of compressed air via the respective stop valves.

So that when the conduit 22*f* is connected to the compressed air supply source, the movable pin 22*a* is displaced away from the pneumatic cylinder 22*b*. On the other hand, the movable pin 22*a* is displaced toward the inside of the pneumatic cylinder 22*b* by supplying compressed air into said cylinder 22*b* through the conduit 22*e*. The above-mentioned stop valve is called the conventional three-way valve whereby the conduits 22*e* and 22*f* are capable of alternatively connecting to the compressed air supply source or the atmosphere.

When the cylindrical cam box 7 is held in the position whereby the stopper 7*c* engages with the stopper 15*a* and the movable pin 22*a* engages with the recess 7*d* by supplying compressed air through the conduit 22*f*, the traverse guide rails 8 and 9 are held at a position facing the friction roller 4 as shown in FIG. 2. Consequently, the thread 1 introduced to the bobbin 2 by way of the thread guide 10 and the friction roller 4 is wound onto the bobbin 2 while traversing along the axial direction of the bobbin 2.

Figure 3:
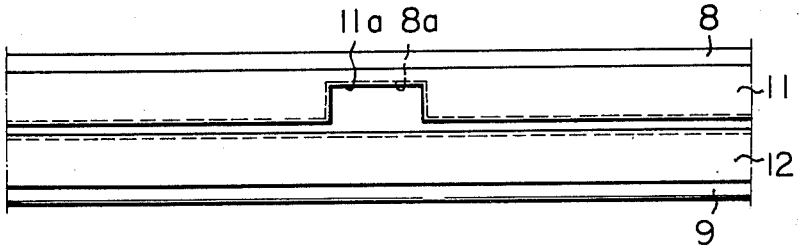
FIG. 3 is a schematic front view of a pair of traverse guide rails shown in FIG. 2.

The above-mentioned traverse motion of the thread guide 10 is created by the rotation of the traverse cam 6. In the above-mentioned embodiment of the traverse device shown in FIGS. 1 and 2, the traverse cam 6 is provided with a pair of endless helically crossing endless guide grooves A and B which are endless guide grooves for creating the traverse motions of two thread guides 10 along the axial direction of the common traverse cam 6 as shown in FIG. 3. To identify the above-mentioned threads guides 10, the thread guide for the guide groove A and the thread guide for the guide groove B are identified as 10*a* and 10*b*, respectively. A ring-shaped guide groove 25 is formed on the cylindrical surface of the cam 6 at a position between the helically crossing endless guide grooves A and B. The shapes of said helically crossing endless guide grooves A and B are symmetrically formed with respect to the ring-shaped guide groove 25. Said helically crossing guide groove A comprises a combination of a helical guide groove 26*a* and a helical guide groove 27*a* which crosses the guide groove 26*a* at crossing points 28*a*, while said helical guide groove B comprises a combination of a helical guide groove 26*b* and a helical guide groove 27*b* which crosses said guide groove 26*b* at crossing points 28*b*. The ends of helical guide grooves 26*a* and 27*a* are connected to each other, while the ends of helical guide grooves 26*b* and 27*b* are connected to each other. Said helical guide groove 26*a* is connected to the ring-shaped guide groove 25 by an auxiliary guide groove 29*a* which is offset from the inside portion of the helical guide groove 26*a*, while the helical guide groove 27*b* connected to the ring-shaped guide groove 25 by an auxiliary guide groove 29*b* which is offset from the inside portion of the helical guide groove 27*b*, as shown in FIG. 4.

A roller 23 is rotatably mounted on a supporting pin 24 projected from the thread guides 10 (10*a*, 10*b*) in such a position that the roller 23 is rotatably engaged in the above-mentioned guide grooves A and B, respectively (FIG. 2). The ring-shaped guide groove 25 is provided with a width more than twice the diameter of the roller 23, while the width of the auxiliary guide grooves 29*a* and 29*b* are also larger than the roller 23 of the thread guides 10 (10*a*, 10*b*).

Figure 4:
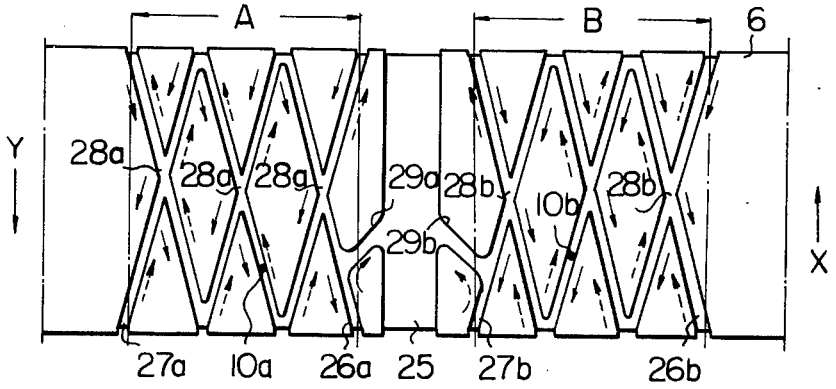
FIG. 4 is a developed view of the traverse cam shown in FIGS. 1 and 2.

Therefore, when the traverse cam 6 is rotated toward the direction represented by an arrow *x* in FIG. 4, the thread guides 10*a* and 10*b* slide along the helical crossing endless guide grooves A and B, respectively, toward directions represented by solid line arrows. Since these thread guides 10a and 10b are restricted in their motions by the guide rails 8 and 9, when the thread guides 10*a* and 10*b* slide along the helical grooves 26*a* and 26*b* respectively, said thread guides 10*a* and 10*b* are displaced toward the right in FIG. 4. On the other hand, when the thread guides 10*a* and 10*b* slide along the helical grooves 27*a* and 27*b* respectively, said thread guides 10*a* and 10*b* are displaced toward the left in FIG. 4. Consequently, the traverse movements of these thread guides 10*a* and 10*b* are created.

When it is required to remove the used thread guides 10*a* and 10*b* from the endless guide grooves A and B respectively, the traverse cam 6 is turned in the direction opposite to the normal running direction of the traverse cam 6. This turning direction is represented by Y in FIG. 4.

According to the above-mentioned turning of the traverse cam 6 in the Y direction, the thread guides 10*a* and 10*b* are introduced into the guide grooves 26*a* and 27*b* respectively as shown by the broken line arrows, and then introduced into the auxiliary guide grooves 29*a* and 29*b* respectively, and finally introduced into the ring-shaped guide groove 25. In this way, these thread guides 10*a* and 10*b* can be easily removed from the ring-shaped guide groove 25.

However, it is necessary for the ring-shaped guide groove 25 to hold thread guides 10*a* and 10*b* in the guide groove 25 until manual operation of removing these thread guides 10*a* and 10*b* from the traverse cam 6 is completed. To attain the above-mentioned function, the thread guide rails 8 and the cover plate 11 are provided with cut out portions 8a and 11a formed at positions facing the ring-shaped guide groove 25, as shown in FIG. 3. The opened spaces of these cut-off portins 8*a* and 11*b* are large enough to permit the free escape of these thread guides 10*a* and 10*b* therefrom. Since the traverse device is constructed as mentioned above, when it is required to change the used thread guides 10*a* and 10*b* for fresh ones, it is desirable to turn the cam box 7 to a position where the guide rails 8 and 9 are placed at a position opposite to the friction roller 4. In this position, the auxilary pin 22*a* is engaged with the recess 7*e* of the cam box 7 and the traverse cam 6 is then turned in the Y direction (FIG. 4).

When it is required to change the used thread guides 10*a* and 10*b* for fresh ones, firstly the driving motor (not shown) is stopped so as to stop the rotation of the traverse cam 6. Next, the movable pin 22*a* is released from the recess 7*d* of the cam box 7 by supplying compressed air into the pneumatic cylinder 22*b* by way of the conduit 22*e*. Then, the cam box 7 is turned until the pin 7*c* engages with the stopper 15*b*. After this happens, the auxiliary pin 22*a* is inserted into the recess 7*e* by supplying compressed air into the pneumatic chamber 22*b* by way of the conduit 22*f*.

Figure 5:
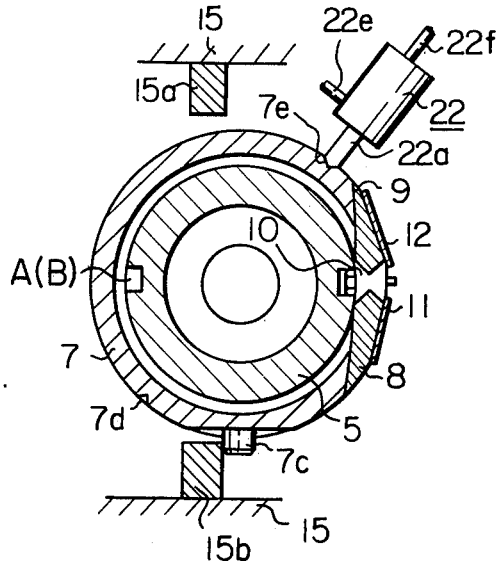
FIG. 5 is a schematic side view of the traverse device shown in FIG. 2, in a condition for changing thread guides.

Therefore, the cam box 7 is stably held in the above-mentioned condition wherein the thread guide rails 8 and 9 are positioned on the opposite side to the friction roller 4. This positioning is shown in FIG. 5.

Next, the traverse cam 6 is turned in the opposite direction of the normal running direction.

The thread guides 10a and 10b slide along the guide grooves A and B in their respective directions represented by the broken line arrows in FIG. 4. They are then introduced into the inside portions of the respective guide grooves 26*a* and 27*b*, which are thereafter introduced into the auxiliary guide grooves 29*a* and 29*b*, respectively. These thread guides 10*a* and 10*b* are introduced into the ring-shaped guide groove 25 by a further turning motion of the traverse cam 6. Since the thread guide rail 8 and the cover 11 are provided with the cut-out portions 8*a* and 11*a* facing to the guide groove 25, these thread guides 10*a* and 10*b* can be manually removed through said cut-out portions 8*a* and 11*a*.

Next, the rollers of the new thread guides are place in the ring-shaped thread guide 25 through said above-mentioned cut-out portions 8*a* and 11*a*, and thereafter, the traverse cam 6 is turned in the normal running direction while said new thread guides are urged toward the guide grooves A and B, respectively. When the entrance of the auxiliary guide grooves 29*a* and 29*b* face these thread guides, these thread guides introduced therein, and thereafter are introduced into the guide grooves 26*a* and 27*b*, respectively by the further turning of the traverse cam 6. Next, compressed air is introduced into the pneumatic cylinder 22*b* by way of the conduit 22*e* so that the auxiliary pin 22*a* is released from the recess 7*e* of the cam box 7. The cam box 7 is then turned until the pin 7*c* engages with the stopper 15*a*. In this condition, the traverse guide rails 8 and 9 are positioned in their normal working positions facing the friction roller 4. Thereafter, compressed air is supplied into the pneumatic cylinder 22*b* by way of the conduit 22*f* so as to engage the auxiliary pin 22*a* into the recess 7*d*. Consequently, the cam box 7 can be stably held in the normal working position. In the above-mentioned operation, the turning motion of the traverse cam 6 can be carried out manually.

As mentioned above, when it is required to exchange the used thread guides for new ones, the thread guide rails 8 and 9 are displaced to the predetermined positions free from the friction roller 4 and, thereafter, the above-mentioned operation for changing thread guides is carried out. Consequently, the friction roller 4 and other related elements don't disturb the above-mentioned thread guide changing operation.

Since the cam box 7 is capable of turning about the axis of the traverse cam 6, even if a thread is jammed between the friction roller 4 and either one of the thread guides 10a and 10b the jammed thread can be easily released from the troubled position between the friction roller 4 and the thread guide 10*a* (10*b*) so that the durability of the thread guides 10*a* (10*b*) can be prolonged.

Since it is not required to separate the thread guide rails 8 and 9 from the cam box 7 when the thread guide changing operation is carried out, the parallel disposition of the thread guide rails 8 and 9 is always maintained so that any troublesome adjustment to dispose the guide rails 8 and 9 in parallel condition, which is inevitable in the conventional traverse device, is perfectly eliminated, according to the present invention.

Further, it is a practical advantage of the traverse device according to the present invention that, since at least a pair of helically crossing guide grooves A and B are symmetrically formed on the cylindrical surface of the traverse cam 5 with respect to the ring-shaped guide groove 25, so as to simultaneously pick up the thread guides 10*a* and 10*b* through the ring-shaped guide groove 25 by turning the traverse cam toward the opposite direction to the normal running direction thereof, the thread guide changing operation can be carried out very easily in a remarkably shortened time in comparison with the case of utilizing the conventional traverse device wherein the relative position of the thread guide rails to the traverse cam is fixed.

The above-mentioned embodiment may be modified within the spirit of the present invention, for example, the shape of the guide grooves A and B, mechansim for turning the cam box 7 about the axis of the traverse cam 6, the mechanism for restricting the range of turning the cam box 7, mechanism for fixing the cam box 7 in the predetermined axial relation with the traverse cam 6, etc., may be modified within the spirit of the present invention defined by the claims. In the above-mentioned embodiment, the cam box 7 is a cylindrical one provided with a horizontal aperture for forming traverse guide groove and the cam box 7 is concentrically disposed to the traverse cam 6. However, a cylindrical cam box 7 having a larger diameter than the above-mentioned embodiment may be disposed in eccentric condition with respect to the axial center of the traverse cam 6, without any drawbacks in comparison with the above-mentioned embodiment of the present invention.

What is claimed is:

1. In a winding apparatus for taking up a thread, provided with a friction roller for rotating a bobbin or thread package formed on said bobbin and a traverse device provided with a cylindrical traverse cam rotatably disposed at a position adjacent to said friction roller in axially parallel condition, said traverse cam provided with an endless helical guide groove formed on a cylindrical surface thereof, and a cam box holding said traverse cam therein and provided with a horizontal aperture formed at a part thereof in parallel condition to a longitudinal axis of said traverse cam, a pair of thread guide rails secured to edge portions of said horizontal aperture of said cam box in parallel condition to said aperture, a thread guide slidably disposed in a horizontal space formed between said guide rails in slidable engaging condition with said endless helical guide groove; an improved traverse device comprising means for supporting said cam box in turnable condition about said longitudinal axis of said traverse cam, means for alternatively locking said cam box at a normal working position where said guide rails face said friction roller or at a predetermined position where said guide rails are held at a position opposite said friction roller with respect to said longitudinal axis of said traverse cam.

2. An improved traverse device according to claim 1, further comprising means for rotatably positioning said cam box at said normal working position or at said predetermined position alternatively.

3. An improved traverse device according to claim 1, wherein said supporting means comprises a pair of frames provided with a sufficient intervened space therebetween to hold said cam box, a pair of cylindrical brackets secured to said frames, respectively, in facing condition in common axial relationship, both end portions of a shaft of said traverse cam bein rotatably supported by said cylindrical brackets respectively, said cam box which holds said traverse cam therein being turnably mounted on said cylindrical brackets respectively.

4. An improved traverse device according to claim 2, wherein said locking means comprises a pair of recesses formed on an outer surface of said cam box at positions corresponding to said normal working position and said predetermined position of said cam box, a pin means disposed at an engageable common position to said recess formed at said position corresponding to said normal working position of said cam box and to said recess formed at said position corresponding to said predetermined position of said cam box, respectively, an actuation means for urging said pin means to either one of said recesses or for displacing said pin means from either one of said recesses.

5. An improved traverse device according to claim 4, wherein said actuation means comprises a pneumatic cylinder capable of being connected to a compressed air supply source, a piston displaceably held in said pneumatic cylinder said pin means connected to said piston.

6. An improved traverse device according to claim 2, wherein said positioning means comprises a pin projected from an outer surface of said cam box, a pair of stoppers projected from said frame at positions corresponding to said normal working position and said predetermined position of said cam box for engagement with said pin.

* * * * *